United States Patent [19]

Lynch

[11] Patent Number: 5,001,787

[45] Date of Patent: Mar. 26, 1991

[54] COMBINATION BATHTUB/SHOWER FACILITY

[75] Inventor: Roger J. Lynch, Coto De Caza, Calif.

[73] Assignee: Kimstock, Inc., Santa Ana, Calif.

[21] Appl. No.: 444,855

[22] Filed: Dec. 4, 1989

[51] Int. Cl.[5] ..... A47K 4/00

[52] U.S. Cl. ..... 4/552; 4/538; 4/568; 4/614

[58] Field of Search ..... 4/552, 538, 596, 612, 4/614, 568, 661, 553, 559, 605, 584, 567, 619

[56] References Cited

U.S. PATENT DOCUMENTS

| | | | |
|---|---|---|---|
| 1,235,091 | 7/1917 | Anderson | 4/552 |
| 1,815,291 | 7/1931 | Druckenmiller | 4/552 |
| 2,508,969 | 5/1950 | Richardson | 4/552 |
| 3,096,526 | 7/1963 | Vecenie | 4/552 X |
| 3,955,219 | 5/1976 | Finch et al. | 4/552 |
| 4,080,710 | 3/1978 | Heys | 4/538 X |
| 4,126,719 | 11/1978 | Kopanagi et al. | 538 X/ |
| 4,153,954 | 5/1979 | Jacuzzi et al. | 4/568 X |
| 4,290,154 | 9/1981 | Benjamin | 4/538 |
| 4,423,528 | 1/1984 | Wiedmeier | 4/614 |
| 4,862,527 | 9/1989 | McAllister | 4/614 X |

*Primary Examiner*—Henry K. Artis
*Attorney, Agent, or Firm*—Arthur W. Fuzak

[57] ABSTRACT

A combination bathtub/shower facility comprised of separately prefabricated shower and bathtub units which are structurally interconnected in such a manner as to maintain the structural, watertight, and aesthetic integrity of the facility. The bathtub and shower units are prefrably of unitary molded construction, e.g. of molded fiberglass construction. The shower unit includes a base portion, and preferably further includes vertically upwardly extending shower walls which are integrally formed with the shower base portion. Alternatively, separately prefabricated shower wall panels may be secureably mounted to the shower base portion. In a presently preferred embodiment, the interconnection of the bathtub and shower units is accomplished by connection facilities which are integral with or easily affixable to the side of the shower base portion which is disposed adjacent to a side wall of the bathtub unit. The connection facilities matingly engage corresponding edge portions of the adjacent side wall of the bathtub unit, in order to facilitate simple, rapid, and efficient assembly of the units during field installation of the combination facility. The corner portion of the bathtub unit which is disposed adjacent to the rear wall of the shower unit is notched out in order to provide some overlap of the two units. An additional lateral shower wall can then be mounted upon the surface portion of the deck of the bathtub unit which overlies the shower base portion of the shower unit. Additional connection facilities may be advantageously provided in order to facilitate either right-handed or left-handed installation of the shower unit. In an alternaitve embodiment, the invention also encompasses a prefabricated unitary combination bathtub/shower unit, in which the shower sub-unit includes a shower base portion and one or more short or truncated shower walls integrally formed therewith, and one or more shower wall extender panels secured to the short shower walls.

14 Claims, 5 Drawing Sheets

COMBINATION BATHTUB/SHOWER FACILITY

FIELD OF THE INVENTION

The present invention relates generally to the field of bathtub and shower facilities, and more particularly, to a combination bathtub/shower facility comprised of separately prefabricated bathtub and shower units which are assembled together during installation thereof.

BACKGROUND OF THE INVENTION

In the environment of new home construction, it has long been the conventional practice to lay the foundation and to construct the structural framing thereupon prior to performing additional steps such as drywalling, wiring, plumbing, and installation of floor and wall coverings, HVAC systems, doors, windows, cabinets, fixtures, and other items, including bathroom facilities such as bathtubs and/or showers. With particular regard to the installation of bathtubs, the typical installation procedure employed has been to construct a three-sided wooden support structure (open at one end thereof) in the space provided in the home therefor (this step being sometimes referred to in the industry as "ponywalling"), and to then install or fit a porcelain or metal tub within the support structure. Thereafter, a waterproof-type (i.e. exterior-grade) wallboard, e.g. gypsum board, is mounted to the roughed-in wall surfaces adjacent to the bathtub (this step being sometimes referred to in the industry as "greenboarding"). Thenceforth, a moisture-impervious adhesive, e.g. a mastic, is applied or tarred to the entire surface area of the wallboard (this step being sometimes referred to in the industry as "hot mopping"), and ceramic tile installed thereon. After the mastic has been allowed to set (e.g. after 24 hours), the tiled walls are grouted. Of course, the joints between the bathtub and the walls are sealed with a flexible, waterproof caulking compound such as silicone sealant to ensure the watertight integrity of the installation. A shower head may be installed in the wall adjacent to the forward portion of the bathtub to render a combination bathtub/shower facility, in which case, the bathtub enclosure doubles as a shower stall, which may be enhanced by the installation of sliding glass doors or other facilities for fully enclosing the bathtub. Alternatively, a separate shower stall may be installed. Of course, this additional installation would also entail most of the same installation steps required for installation of the bathtub.

The disadvantages and shortcomings of the above-described conventional bathtub/shower facility installation are numerous. Namely, this conventional installation procedure is labor-intensive, time-consuming, and expensive, from both a labor and materials standpoint. Further, due to the inherent complexity and extensive human intervention necessitated by this type of installation, the quality and integrity of these installations are prone to suffer. Of course, these disadvantages are magnified when a separate shower unit installation is made. Further, due to the occurrence of such inevitable problems as tile staining/discoloration, grout deterioration, tile damage (e.g. due to cracking, chipping, etc.), the cost and difficulty of maintenance is unduly high, and the useful life (i.e. the mean time between replacement installations) thereof unnecessarily limited.

However, with the advent of prefabricated, e.g. molded fiberglass or fiberglass-reinforced plastic, bathtub and shower units, many of the above-delineated disadvantages and shortcomings of conventional tub/-shower installations have been either overcome or greatly mitigated. More particularly, the installation of molded fiberglass bathtub and shower units does not require ponywalling, greenboarding, hot mopping, and tiling, and is therefore far less expensive (from both a labor and materials standpoint) and time-consuming than the typical installation of conventional bathtub and shower facilities. Also, due to the minimization of the possibility of human error, the quality and integrity of molded fiberglass bathtub and shower unit installations is generally considered superior to that of conventional bathtub and shower installations. Further, the molded fiberglass bathtub and shower units are much easier and less costly to maintain, and have a much longer useful life than their conventional counterparts. Yet further, the unitary construction of molded fiberglass bathtub and shower units provides aesthetic benefits as well.

In general, molded fiberglass bathtub and shower unit are currently available as either separate or combination units. As a practical matter, separate bathtub and shower units must be installed in substantially spaced relation to each other, since closely adjoining or directly abutting bathtub and shower units necessarily have a small gap area therebetween, and this small gap area would be highly vulnerable to mildewing and other problems associated with moisture-vapor encroachment therein due to humidity differentials between the gap area and the interior regions of the bathtub and shower units. This problem is further compounded by the fact that the gap area is very difficult to access.

Therefore, in instances wherein it is desired to integrate the bathtub and shower units, for aesthetic and/or utilitarian reasons, combination units are employed. Currently available combination units are of unitary molded construction, with the bathtub and shower units being integrally formed together. However, due to the space limitations imposed by the dimensions of the hallways and door openings leading from the outside of the house to the bathroom where the unit is to be installed (whether it be a new home or retrofit installation), the maximum dimensions of the molded fiberglass combination tub/shower units have heretofore been unduly limited, thereby imposing unnecessary constraints on the design and utility thereof. Further, due to the work-site space limitations, as well as feasibility limitations regarding the dimensions of molded articles, the shower unit portion of the currently available combination tub/shower units do not include the shower walls defining the shower stall enclosure. Otherwise stated, the shower unit portion of the presently available combination units does not include a shower stall, but rather, only the base portion thereof. This feature constitutes a shortcoming, since the walls of the house or building where the unit is installed, which are to serve as the walls defining the shower stall enclosure, must be greenboarded, hot mopped, and tiled, which procedure entails the disadvantages and shortcomings previously discussed in connection with conventional facilities, albeit to a lesser extent.

Based on the above and foregoing, it can be appreciated that there presently exists a need for a combination bathtub/shower facility which is not encumbered with the problems associated with conventional installations, while simultaneously providing the capability of larger dimensions than that of presently available prefabricated combination tub/shower units, as well as providing a full shower stall enclosure comprised chiefly or completely of prefabricated components, as opposed to only the base portion thereof.

The present invention fulfills this long-standing need.

SUMMARY OF THE INVENTION

The present invention, in its primary embodiment, encompasses a combination bathtub/shower facility comprised of separately prefabricated shower and bathtub units which arc structurally interconnected, during installation, preferably, in such a manner as to maintain the structural, watertight, and aesthetic integrity of the facility. The prefabricated bathtub and shower units are each preferably of unitary molded construction, e.g. of molded fiberglass construction. The shower unit may suitably include only a shower base portion, but preferably further includes vertically upwardly extending shower walls which are integrally formed with the shower base portion. Alternatively, in the embodiment wherein the shower unit includes only the shower base portion, separately prefabricated shower wall panels may be securably mounted to the shower base portion to provide an essentially prefabricated shower stall unit.

Although the particular manner of interconnecting the bathtub and shower units is not limiting to the invention, as there are innumerable ways in which to accomplish this interconnection it is presently preferred to provide connection facilities integral with or easily affixable to the side of the shower base portion of the shower unit which is disposed adjacent to the bathtub unit, with the connection facilities being adapted to matingly engage corresponding edge portions of the adjacent side wall of the bathtub unit, in order to facilitate simple, rapid, and efficient assembly of the units during installation of the combination facility. Further, in a preferred embodiment of the present invention, the corner portion of the bathtub unit which is disposed adjacent to the rear wall of the shower unit is notched out n order to provide some overlap of the two units at the corner interface. An additional lateral shower wall can then be mounted upon the surface portion of the deck of the bathtub unit which overlaps the shower base portion of the shower unit. Of course, all joints and interfaces between the two units are sealed to ensure the watertight integrity of the facility. After the shower door and its associated retaining frame are installed, a complete, essentially prefabricated shower stall is provided.

In a particularly advantageous embodiment of the instant invention, additional unit interconnection facilities are provided in order to facilitate either right-handed or left-handed installation of the shower unit.

The present invention also encompasses, in another of its embodiments, a prefabricated, unitary combination bathtub/shower unit, in which the shower sub unit includes a shower base portion and one or more short or truncated shower walls integrally formed therewith, and one or more shower wall extender panels secured to the truncated shower walls. Alternatively, only the shower base portion (without truncated shower walls) is integrally formed with the bathtub sub-unit, with separately prefabricated shower wall panels being affixed thereto.

DETAILED DESCRIPTION OF THE INVENTION

Figure 1:
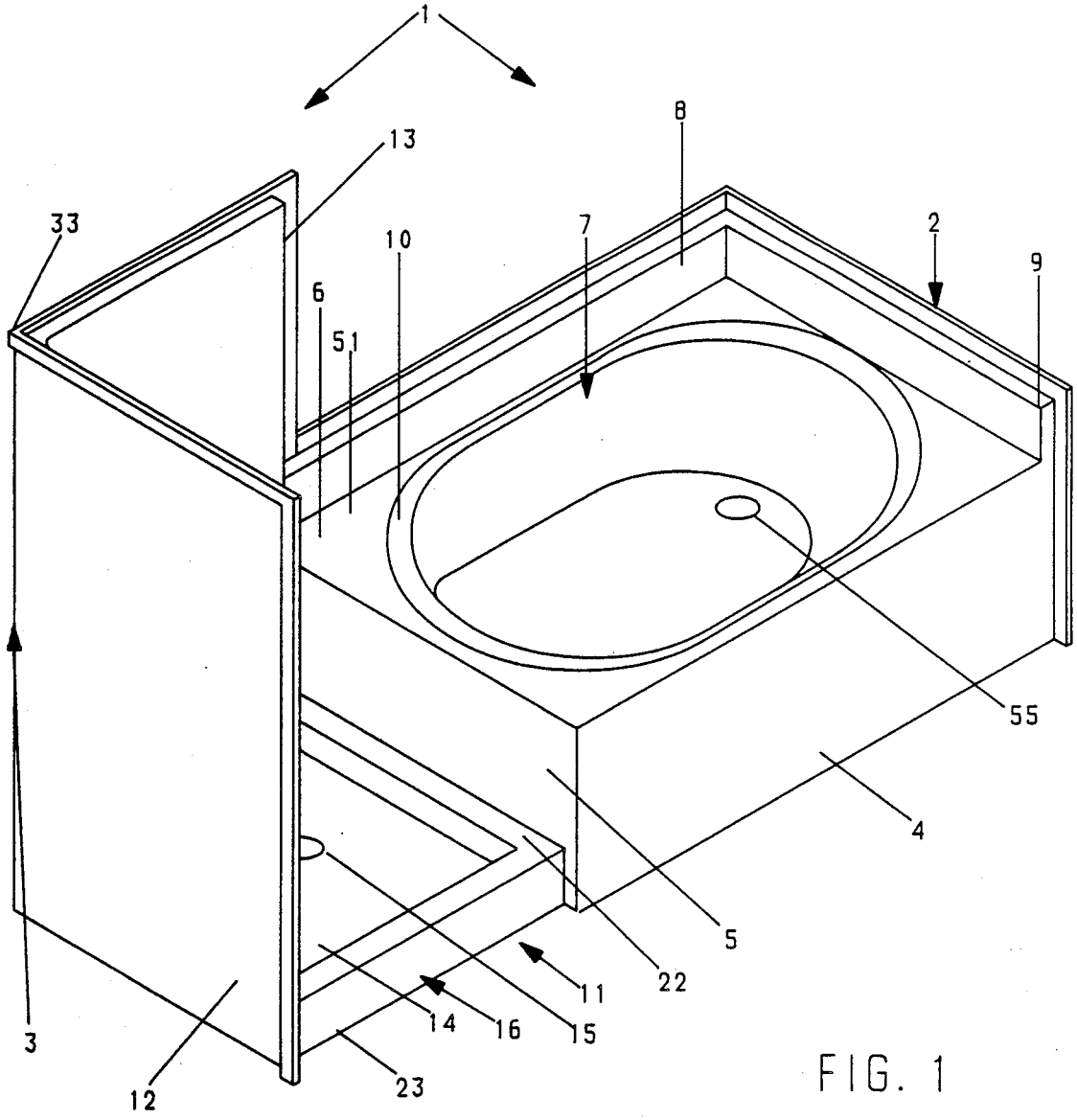
FIG. 1 is a perspective view of a combination bathtub/shower facility embodying features of the instant invention.

Referring now to FIG. 1, there is depicted a combination bathtub/shower facility 1 embodying features of the instant invention. In order to facilitate greater ease in the description of the invention the combination bathtub/shower facility 1 will be hereinafter referred to simply as the combo facility 1. The combo facility 1 is comprised of two separately prefabricated components, namely, a bathtub unit 2 and a shower unit 3. In the presently preferred embodiment of the instant invention, the tub unit 2 and the shower unit 3 are each of unitary construction. More particularly, the tub and shower units 2,3 are preferably molded fiberglass articles which are manufactured in a manner which is already well known in the art. However it should be clearly understood that neither the type of materials utilized nor the type of process employed for fabricating or manufacturing the tub and shower units 2,3 is limiting to the invention. Also, the term "prefabricated" is intended in its broadest meaning. For example, the terminology "prefabricated bathtub and shower units", as employed herein, is intended to encompass bathtub and shower units which are comprised of a plurality of manufactured components which are assembled together.

With continuing reference to FIG. 1, the bathtub unit 2 is shown to include a generally rectangular structure comprised of four walls (only two (4,5) of which are shown) supporting deck 6, and a tub cavity 7 formed in a central region of the structure. The bathtub unit 2 further includes a wainscot 8 extending upwardly from the rear and rightmost (as viewed in FIG. 1) portions of the deck 6. In actuality, the wainscot 8 is merely an integral, upper extension of the rear and rightmost walls (not shown) of the bathtub unit 2, which extension begins in the plane of the deck 6. In essence then, the wainscot 8 constitutes a truncated or abbreviated upper wall portion of the walls of the tub unit 2 which are located adjacent to the walls (not shown) of the house or building (not shown) in which the combo facility 1 is installed. A tab or flange 9 is also provided around the upper edge periphery of the wainscot 8 and right edge of the front wall or front skirt 4 of the bathtub unit 2 to facilitate attachment of the tub unit 2 to the walls of the structure in which it is installed. The manner in which this attachment is made is well-known in tho art and need not be fully described herein. Suffice it to say, that nails (not shown) are driven through the flange 9, which is often referred to as a nailing flange, and into studs (not shown) which support the walls of the structure in which the combination facility 1 is installed.

A lip 10 can be suitably formed in the deck 6 to help minimize the possibility of overflow of water from the tub cavity 7, e.g. when it is overfilled or when water contained therein is displaced therefrom by a person situated within the tub cavity 7. Also, a tub drain hole 55 is preferably provided in the forward portion of the tub cavity 7.

With continuing reference to FIG. 1, the shower unit 3 is shown to include a base portion 11 and upwardly extending shower walls 12,13 partially defining a shower stall enclosure around the base portion 11. The base portion 11 is comprised of a base plate or shower pan 14 which defines a surface which is preferably sloped radially downwardly and inwardly from its outer edges to a shower drain hole 15 formed centrally therein; and, a curb structure or shower dam 16, which cooperates with the shower walls 12,13 to define a receptacle for retention of water which accumulates (during actual usage of the unit) within the base portion 11 at a rate which exceeds the drainage rate capacity of the drain hole 15 and drainage system (not shown) functionally associated therewith upon installation of the combo facility 1. Alternatively stated, the shower dam 16 functions, in the conventional manner, as a dam or water barrier to isolate water contained in the interior of the shower unit 3 from the exterior.

Figure 2:
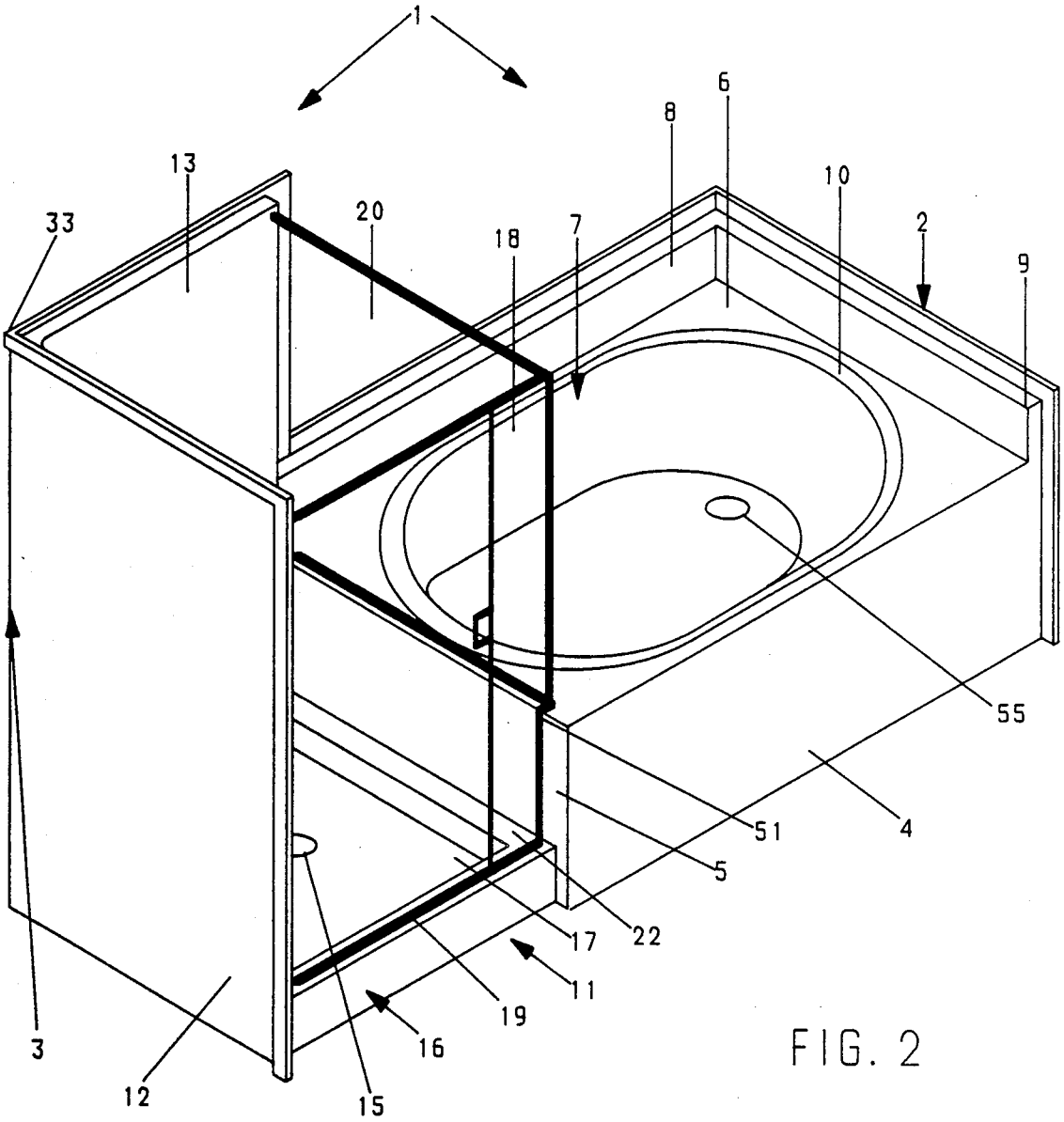
FIG. 2 is a perspective view of the combination bathtub/shower facility shown in FIG. 1, with additional features.

Referring now to FIG. 2, it can be seen that the shower stall enclosure of shower unit 3 is completed by a shower door 17 and associated door retaining frame 18 attached in conventional fashion to the frontal, upper planar surface 19 of the shower dam 16, and a lateral shower wall 20 attached, by any convenient means, to lateral ledge portion 51 of the deck 6 of the bathtub unit 2, in opposed relation to the integrally formed lateral shower wall 12. Although not limiting to the invention, it is preferred that the lateral shower wall 20 be installed in such a manner as to provide a flush boundary or demarcation between the shower unit 3 and the bathtub unit 2. The shower door 17, the door retaining frame 18, and/or the lateral shower wall 20 can be pre-installed at an off site location, e.g. at the manufacturing site, or can be installed on site. In this vein, it should be appreciated that neither the exact manner nor the timing of the installation of these components is limiting to the invention. However, to ease the assembly of the bathtub and shower units 2,3 in a manner to be described in detail hereinafter, it is preferred that at least the lateral shower wall 20 be installed after the tub and shower units 2,3 have been connected together. In any event, it will be recognized that upon completion of the installation of the shower door 17, the door retaining frame 18, and the lateral shower wall 20, the shower unit 3 will constitute a complete or full shower stall enclosure, as opposed to only the base portion thereof. Optionally, the side of the shower unit 3 situated adjacent to the bathtub unit 2 can be left open, thereby precluding the need for the lateral shower wall 20.

The lateral and rear shower walls 12,13 are provided with an outwardly extending nailing flange 33 around the edge periphery thereof, to facilitate attachment of the shower unit 3 to the walls of the structure in which it is installed in the well-known manner previously described in connection with this aspect of the bathtub unit 2.

The discussion will now turn to a description of the primary novel aspect of the present invention. More particularly in its broadest aspect, the primary novelty of the present inventive concept resides in the provision of means for structurally interconnecting or assembling together the separate molded fiberglass bathtub and shower units 2,3, to render the combo facility of the instant invention. In the ensuing discussion, various means for structurally interconnecting the units 2,3 are disclosed. However, it should be clearly understood that the particular type of structurally interconnecting means employed is not limiting to the broader inventive concept of a combo facility having separately prefabricated units which are securely interconnected, even though each particular type of structurally interconnecting means may constitute an independently inventive concept in its own right.

Figure 3:
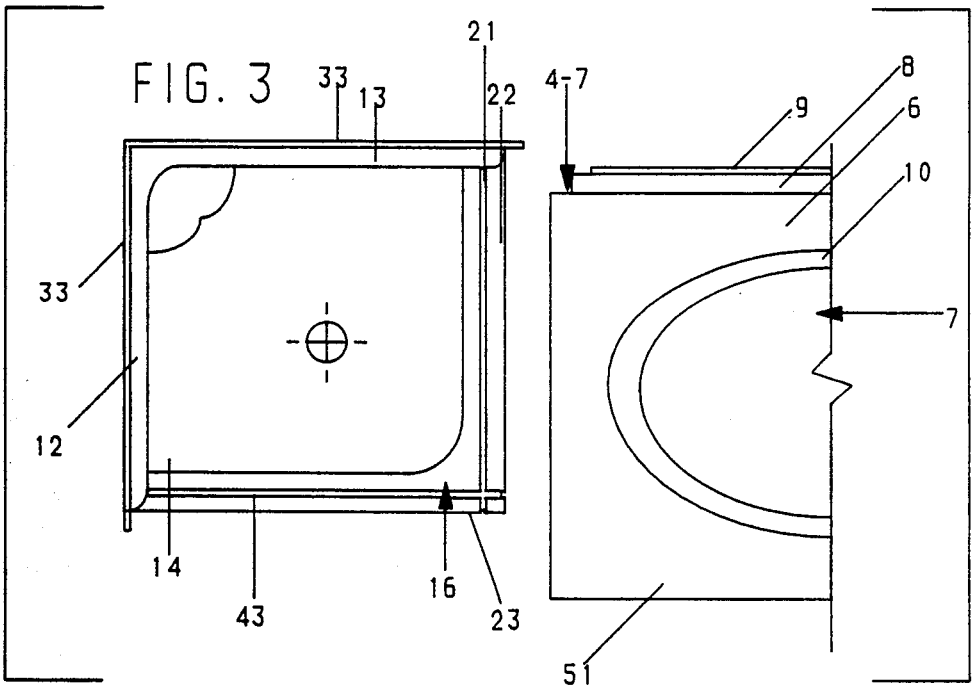
FIG. 3 is a partial plan view of the combination bathtub/shower facility shown in FIG. 1, with a portion of the bathtub unit thereof being cutaway and with the bathtub and shower units thereof being shown in a state of disassembly.
Figure 4:
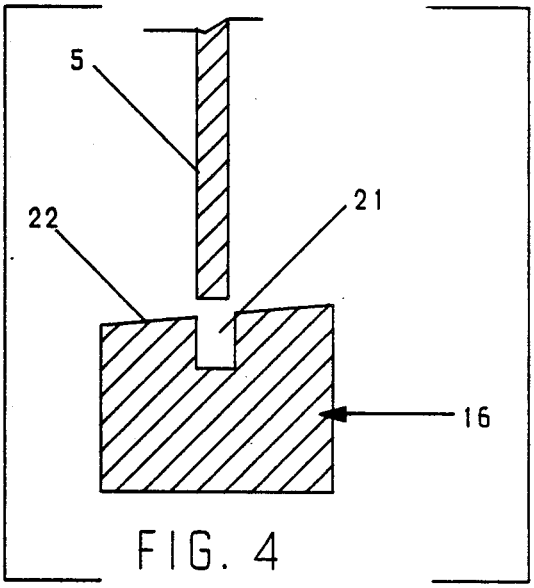
FIG. 4 is a frontal, cross-sectional, isolation view of one embodiment of the bathtub/shower units joint connection, shown in disassembly.
Figure 5:
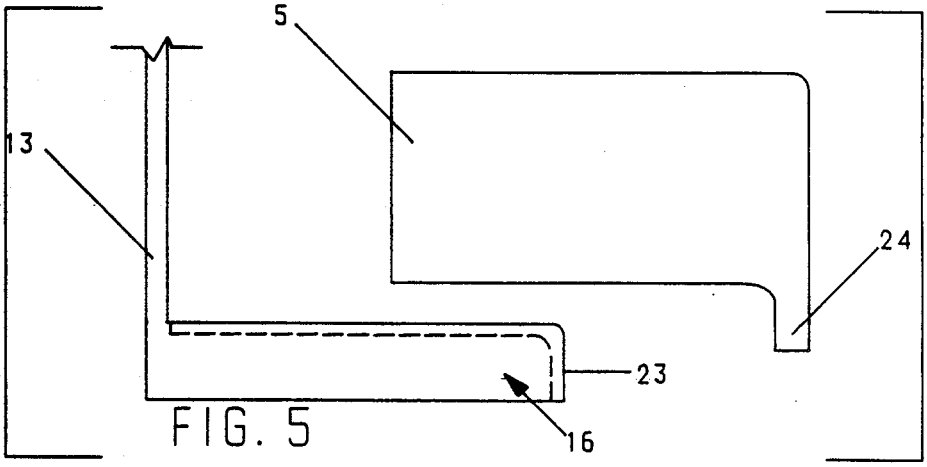
FIG. 5 is a side, elevational, isolation view, in disassembly, of the joint connection shown in FIG. 4.

With specific reference now to FIGS. 2–4, there can be seen various views of a longitudinally extending channel or groove 21 provided in rearwardly extending or lateral upper planar surface 22 of the shower dam 16 along the lengthwise direction thereof, with the groove 21 continuing in a linear fashion down frontal face 23 of the shower dam 16. Although not critical or limiting to the practice or scope of the present invention, the groove 21 is preferably positioned generally centrally relative to the longitudinal edges of the lateral upper planar surface 22 of the shower dam 16, to thereby allow the tub unit 2 to overlap the lateral upper planar surface 22 by a distance sufficient to present a sufficiently broad lateral ledge portion 51 of the deck 6 for the lateral shower wall 20 to be mounted upon. The portion of the groove 21 provided in the lateral upper planar surface 22 of the shower dam 16 is adapted (i.e. shaped and dimensioned) to securely receive the lower edge portion of the lateral or pony wall 5 of the bathtub unit 2, for mating engagement therewith. Similarly, the portion of the groove 21 provided in the frontal face 23 of the shower dam 16 is adapted to securely receive the vertical, inner edge portion of elongated side panel portion 24 of the pony wall 5 of the bathtub unit 2, for mating engagement therewith. Although not limiting to the invention, it is preferred that the manufacturing tolerances are such as to provide a press-fit of the edge portions of the pony wall 5 within the groove 21, to thereby render a secure tongue-in-groove joint which provides a rigid structural interconnection of the bathtub and shower units 2,3.

Although the groove 21 is shown to be generally U shaped it should be readily recognized that the groove 21 could alternatively assume any convenient geometric shape or structural configuration, as long as the corresponding edge portions of the pony wall 5 are apropriately to matingly engage therewith in such a manner as to provide an adequately secure interconnection of the bathtub and shower units 2,3. Although the number of ways in which this can be achieved is far too great to render exhaustive inclusion herein practical, several alternative embodiments which are presently envisaged will now be described for purely illustrative purposes.

Figure 6:
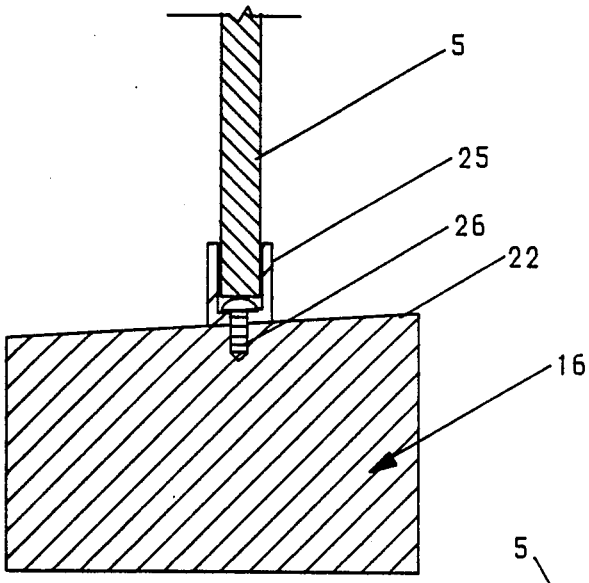
FIG. 6 is a frontal, cross sectional, isolation view of another embodiment of the joint connection.

Referring particularly now to FIG. 6, there is shown an alternative embodiment of the structural joint which interconnects the bathtub and shower units 2,3. In this embodiment, an extruded channel 25 comprised of any convenient material, e.g. vinyl or aluminum, is affixed by any convenient fastening means, e.g. by screws 26, to the lateral upper planar surface 22 and the frontal face 23 of the shower dam 16 in lieu of molding, routing, or otherwise providing the groove 21 therein. The channel 25 functions in a similar manner as the groove 21 to receive the corresponding, mating, lower and vertical, inside edge portions of the pony wall 5, to thereby securely interconnect the bathtub and shower units 2,3. The channel 25 could be pre-installed or installed on-site, and can be comprised of a single piece, or or two or more segments. Alternatively, the channel 25 could be comprised of a pair of appropriately laterally spaced-apart, elongated splines or rails (not shown) integrally formed on the upper planar surface 22 and the frontal face 23 of the shower dam 16.

Figure 7:
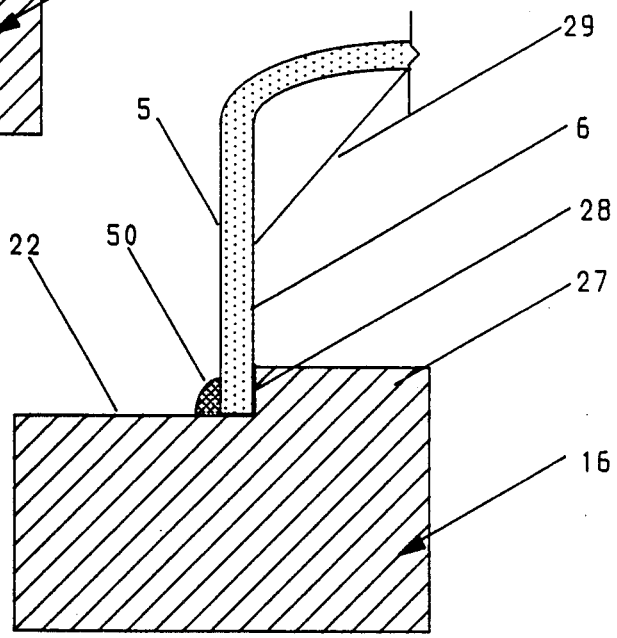
FIG. 7 is a frontal, cross-sectional, isolation view of a further embodiment of the joint connection.

Referring particularly now to FIG. 7, there is shown another alternative embodiment of the structural joint which interconnects the bathtub and shower units 2,3. In this embodiment, a raised pedestal or shelf 27 is formed on the upper planar surface 22 and the frontal face 23 of the shower dam 16. The lower and vertical, inside edge portions of the pony wall 5 abut the inside face 28 of the shelf 27, in an overlapping manner. The overlapping edge portions of the pony wall 5 can be affixed or secured to the inside face 28 of the shelf 27 in any convenient manner, e.g. by means of a bead or ribbon 50 of waterproof structural adhesive material, such as epoxy, acrylic, or structural silicone sealant. Alternatively, or additionally, mechanical fastening means, such as screws, bolts, rivets, or the like (not shown) may be employed to affix the pony wall 5 to the pedestal 27. The structural integrity of the lap joint may be enhanced by means of a structural angle support brace 29 or any other convenient structural reinforcement means attached between the inside wall surfaces of the pony wall 5 and the deck 6 of the bathtub unit 2, for example.

Figure 8:
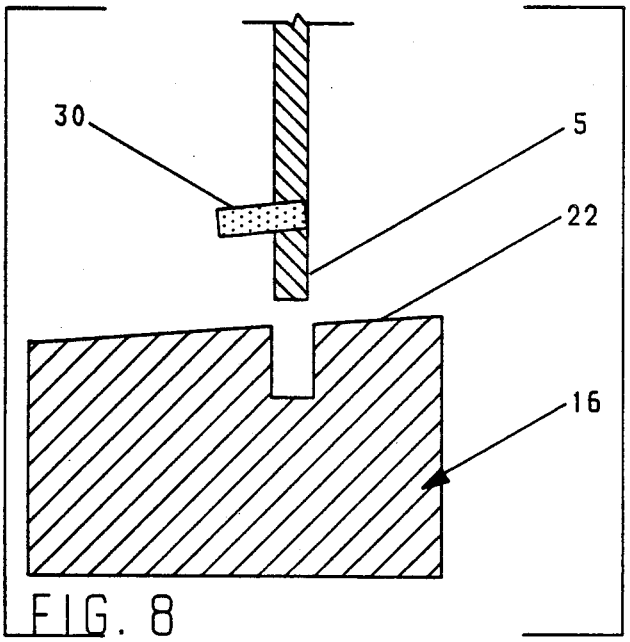
FIG. 8 is a frontal, cross sectional, isolation view of yet another embodiment of the joint connection

Referring particularly now to FIG. 8, there is shown yet another alternative embodiment of the structural joint which interconnects the bathtub and shower units 2,3. In this embodiment, the lower and vertical, inside edge portions of the pony wall 5 are provided with a laterally outwardly extending flange 30 which can be suitably fastened or secured to the lateral upper planar surface 22 and the frontal face 23 of the shower dam 16 by any convenient means. Alternatively, a plurality of intermittent tabs (not shown) could be substituted for the flange 30.

Other types of joints that may be suitably employed to securely interconnect the bathtub and shower units 2,3 include dado, mortise and tenon, dovetail, splined, box, or yoke/bridle joints of course, this list is merely illustrative, and is certainly not exhaustive or limiting to the instant invention.

Figure 9:
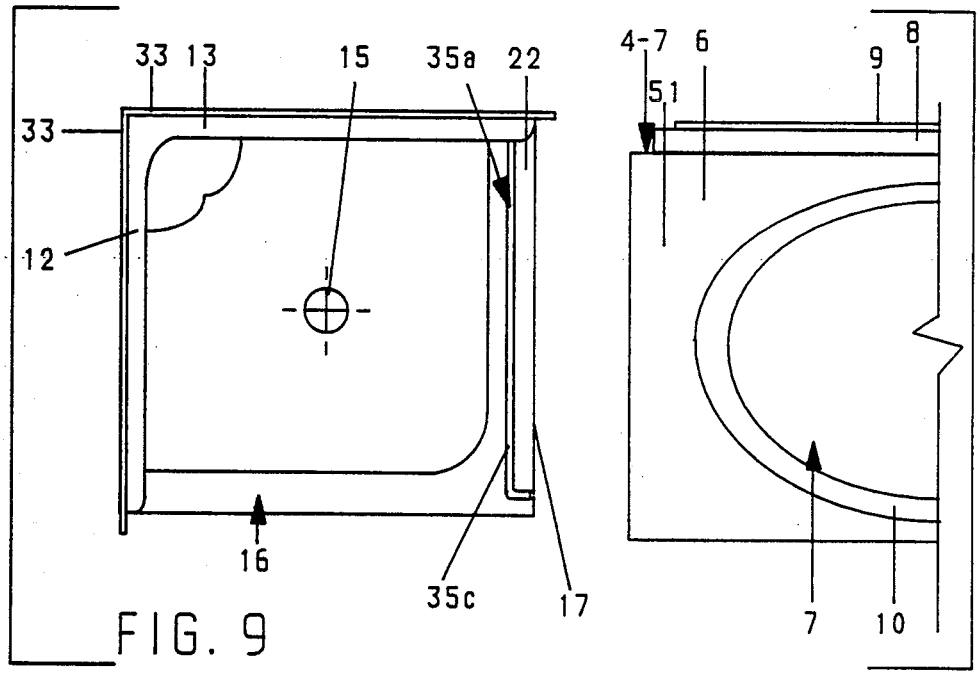
FIG. 9 is an isolation plan view of an alternative embodiment of the Shower dam of the combination bathtub/shower facility depicted in FIG. 1.
Figure 10:
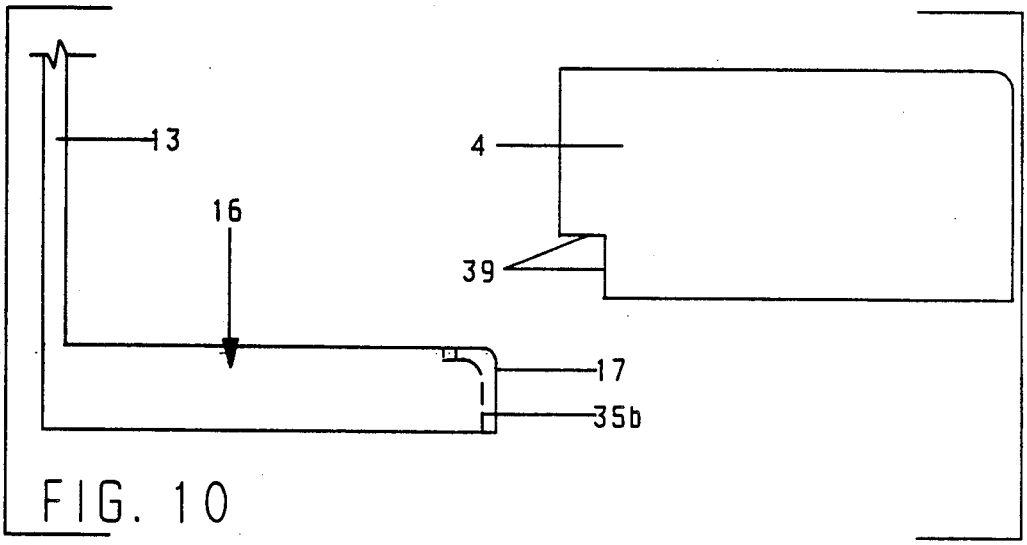
FIG. 10 is a side, elevational, isolation view of an alternative configuration of the bathtub unit/shower unit joint.

Although FIGS. 2 and 3 depict the frontal face 23 of the shower dam 16 to be recessed relative to the front skirt 4 of the bathtub unit 2, it should be readily appreciated that the bathtub and shower units 2,3 can be assembled together in a manner such that the frontal face 23 of the shower dam 16 and the front skirt 4 of the bathtub unit 3 are flush with each other or such that the front skirt 4 of the bathtub unit 3 is recessed relative to the frontal face 23 of the shower dam 16. For example, in the alternative embodiment of the present invention depicted in FIGS. 9 and 10, a groove 35 is provided in the lateral upper planar surface 22 of the shower dam 16 in lieu of the groove 21 described hereinbefore. The groove 35 consists of a first linear portion 35*a* disposed between the longitudinal edges of the planar surface area 22, a second linear portion 35*b* extending longitudinally downwardly along the vertical, outer marginal edge portion of the inner lateral wall 37 of the shower dam 16, and a transverse portion 35*c* connecting the first and second linear portions 35*a*, 35*b*. The lower edge portion of the pony wall 5 matingly engages the first linear portion 35*a* of the groove 35; the lower edge portion of notched out portion 39 of the front skirt 4 matingly engages the transverse portion 35*c* of the groove 35; and the vertical edge portion of the front skirt 4 matingly engages the second linear portion 35*b* of the groove 35, to thereby securely interconnect the bathtub and shower units 2,3 in such a manner that the front skirt 4 of the bathtub unit 2 is recessed relative to the frontal face 23 of the shower unit 3.

Of course, the joint, regardless of the type employed, is finished in the conventional manner, i.e. by application of a bead, strip, or ribbon of a waterproof, flexible caulking compound, e.g. silicone sealant. As is the customary practice in the art, care must be taken to ensure that the sealant permanently adheres to both or the adjoining surfaces defining the joint, to thereby provide a watertight seal which effectively prevents any intrusion or encroachment of moisture or vapor through the joint and into the area underneath the tub unit 2. Also, in order to minimize the possibility of water, which could eventually damage or deteriorate the seal, from reaching the joint seal, the lateral upper planar surface 22 is preferably pitched or sloped downwardly from its outer edge towards its inner edge, as can be seen in FIG. 4, to thereby provide a water-shed effect. This feature further ensures the watertight integrity of the joint seal as well as extending the useful life thereof.

Another particularly advantageous feature of the instant invention is the provision of a second means for securely interconnecting the tub and shower units 2,3, wherein the second means is configured such as to enable the shower unit 3 to be connected to the right hand side of the bathtub unit 2 (as viewed in FIGS. 1 and 2) by merely reversing the orientation of the bathtub and shower units 2,3 relative to their depicted orientation in FIGS. 1 and 2. This feature thereby precludes the necessity of manufacturing separate "left-handed" and "right-handed" types of shower units, consequently simplifying the manufacture or fabrication process and inventory control procedure regarding these units. Further, this versatility afforded by this feature eliminates field/installation problems and delays attributable to errors in the ordering or delivery of separate "right-handed" and "left-handed" types of shower units.

In general, in order to achieve the above-stated left and right-handed versatility, it will be appreciated that the second securely interconnecting means is associated with the frontal portion of the shower dam 16, as opposed to the lateral or rearwardly-extending portion of the shower dam 16 as was described hereinbefore in connection with the left-handed shower unit installation depicted in FIGS. 1 and 2. More particularly, with reference again to FIG 3, there can be seen a second groove 43 extending longitudinally along the horizontal dimension of the shower dam 16, and then longitudinally downwardly along the vertical, outer marginal edge portion of the inner lateral wall 37 of the shower dam 16. This groove 43 constitutes one particular embodiment of the above defined second securely interconnecting means, with the provision of the second groove 43, the shower unit 3 can be easily installed in a "right-handed" configuration rather than the "left-handed" configuration shown in FIGS. 1 and 2, by merely rotating the bathtub unit 2 to reverse its orientation from that illustrated in FIGS. 1 and 2, (i.e. so that the pony wail 5 faces to the right rather than to the left), and by rotating the shower unit 3 in the same manner to reverse its orientation, and then, positioning the reverse oriented shower unit 3 on the right-hand side of the reverse-oriented tub unit 2. Thereafter, the assembly procedure is exactly the same as that previously described in connection with the "left handed installation. Of course, all of the alternative structural joint embodiments discussed in connection with the description of the "left-handed" installation are equally applicable to the right-handed" installation.

As can be seen in FIG. 2, the corner portion of the deck 6, rear wall (not shown), pony wall 5, and wainscot B of the tub unit 2 disposed adjacent to the rear shower wall 13, is notched out to allow the bathtub unit 2 to wrap around the corresponding corner portion of the rear shower wall 13, and to provide the deck 6 with a sufficiently wide lateral ledge portion 51 for the shower lateral wall 20 to be mounted upon. The notched out portion 47 of the bathtub unit 2 is best seen in FIG. 3, wherein it can be clearly seen that the shape of the notched-out portion 47 is made to accomodate the shape of the corner portion of the rear shower wall 13 which it overlaps. The tolerances are preferably such as to ensure snug abutment of the adjoining surfaces of the notched out portion 47 and the corresponding corner portion of the rear shower wall 13. However, it should be clear that the particular manner in which this corner fit or interface is achieved is not a limiting aspect of the present invention. Of course, a bead or ribbon (not shown) of flexible waterproof caulking compound, e.g. silicone sealant, is applied in a manner well-known in the art along this corner interface to provide a secure, watertight seal between the adjoining surfaces of the rear shower wall 13 of the shower unit 3, and the deck 6, pony wall 5, rear wall (not shown), and wainscot 8 of the bathtub unit 2.

Although the shower unit 3 has been previously described herein as including upper upwardly extending shower walls 12,13 formed integrally with the base portion 11, it should be clearly understood that these shower walls could instead be separately prefabricated and then attached by any convenient means, e.g bolts or screws, to the base portion 11, either on site or at an off-site location. Alternatively, the shower walls 12,13 could be shortened or truncated to facilitate ease of manufacture/prefabrication of the combo facility 1, as well as ease of handling and installation of the same. In this instance, shower wall extender panels (not shown) could be separately prefabricated and then attached to the truncated version of the shower walls 12,13.

Moreover, although the primary thrust of the present invention and the foregoing disclosure relate to a combination tub/shower facility comprised of two separately prefabricated units, it should be appreciated that the independent inventive concept of attaching prefabricated shower walls or wall extender panels to a shower unit can also be advantageously employed in connection with either a unitary or two-part combo facility.

Also, it should be clearly understood that neither the overall geometric shape or structural configuration of the combo facility 1 nor that of its constituent parts is in any way smiting to the scope of the present invention. Further, although the present invention has been described in some detail, it should be clearly understood that many variations and/or modifications to the basic inventive concepts herein taught which may appear to those skilled in the pertinent art, fall within the spirit and scope of the present invention, which should be interpreted solely on the basis of the following appended claims.

What is claimed is:

1. A combination bath/shower facility comprising:
a prefabricated bathtub unit of unitary molded construction; said bathtub unit comprising:
a support structure having first, second, third and fourth walls integrally joined together at their vertical edges to form an enclosure;
a tub disposed within said enclosure formed by said support structure;
a deck integrally joined with the upper edge periphery of said tub and with the upper edge periphery of said support structure;
wherein said support structure supports said tub and said deck;
a separately prefabricated shower unit of unitary molded construction; said shower unit comprising:
a shower pan having first, second, third and fourth edges; and,
a curb structure defining a shower dam including a first portion integrally formed with said first edge of said shower pan, and a second portion integrally formed with said second edge of said shower pan; and means for securely interconnecting said bathtub unit and said shower unit.

2. The combination bathtub/shower facility as set forth in claim 1, wherein said securely interconnecting means comprises:
first connecting means associated with said shower dam of said unit; and,
second connecting means associated with said support structure of said bathtub unit, wherein said first and second connecting means are securely interconnected to each other.

3. The combination bathtub/shower facility as set forth in claim 2, wherein:
said first portion of said shower dam is comprised of a first leg of said curb structure, said first leg including generally longitudinally extending inner and outer walls integrally joined together along their upper longitudinal edges by a generally planar surface; and, said second portion of said shower dam is comprised of
a second leg of said curb structure, said second leg including generally longitudinally extending inner and . . . outer walls integrally joined together along their upper longitudinal edges by a generally planar surface.

4. The combination bathtub/shower facility as set forth in claim 3, wherein:
said first connecting means comprises a longitudinally extending groove formed in said planar surface of said shower dam first portion, between said upper longitudinal edges thereof;

said second connecting means comprises the lower edge portion of said first wall of said support structure of said bathtub unit; and, said groove and said lower edge portion of said first wall of said support structure matingly engage each other to provide a structural joint securely interconnecting said bathtub and shower units.

5. The combination bathtub/shower facility as set forth in claim 3, wherein:

said first wall of said support structure of said bathtub unit has an overall length which is greater than the length of said shower dam first portion;

said first wall of said support structure is comprised of a major wall portion having a length equal to the difference between the overall length of said first wall and the length of said major wall portion thereof; the bottom edge of said major wall portion is spaced from a base plane defined by the bottom edges of said second, third and fourth walls of said bathtub unit support structure, whereas the bottom edge of said side panel portion is in common with said base plane, thereby providing said side panel portion with a vertical inner edge having a height equal to the distance between the bottom edge of the first wall and said base plane;

said first connecting means comprises a continuous groove including a longitudinally extending first groove portion formed in said planar surface of said first portion of said shower dam, and a vertically extending second groove portion formed in said outer wall of said second portion of said shower dam;

said second connecting means comprises a lower edge portion of said major wall portion and a vertical inner edge portion of said side panel portion of said first wall of said bathtub unit support structure; and, said lower edge portion of said major wall portion and said first groove portion matingly engage each other; to thereby provide a structural joint securely interconnecting said bathtub and said shower units, with said outer wall of said shower dam second portion being recessed relative to said second wall of said bathtub unit support structure disposed generally adjacent thereto.

6. The combination bathtub/shower facility as set forth in claim 3, wherein said shower unit further comprises:

a first shower wall integrally formed with an extending generally vertically upwardly from said third edge of said shower pan; and, a second shower wall integrally formed with and extending vertically upwardly from said forth edge of said shower pan.

7. The combination bathtub/shower facility as set forth in claim 6, wherein:

a corner portion of said bathtub unit defined by respective corner portions of said deck, said first and said third walls of said bathtub unit support, structure disposed adjacent to said first shower wall, is notched out;

said first connecting means comprises first joining means attached to said planar surface of said shower dam first portion, said first joining means being positioned a distance X from said upper longitudinal edge of said inner wall of said shower dam first portion;

said second connecting means comprises second joining means attached to said first wall of said bathtub unit support structure;

said first and said second joining means are securely joined together;

the length of said notched-out corner portion is approximately said distance X, and the width of said notched-out portion is approximately equal to the width of said first shower wall, whereby the adjoining surfaces of said notched-out corner portion and said first shower wall are disposed in abutting relationship with each other; and, a lateral portion of said deck overlies said planar surface of said shower dam first portion by said distance X.

8. The combination bathtub/shower facility as set forth in claim 7, further comprising:

a third shower wall disposed in generally opposed relationship to said second shower wall;

means for securely mounting said third shower wall onto said lateral portion of said deck;

a fourth shower wall including a shower door and a shower door retaining frame, disposed in generally opposed relation to said first shower wall; and means for securely mounting said fourth shower wall to said planar surface of said shower dam second portion.

9. The combination bathtub/shower facility as set forth in claim 7, wherein:

said first joining means comprises a longitudinally extending channel member mounted upon said planar surface of said shower dam first portion;

means for securing said channel member to said planar surface of said shower dam first portion;

said second joining means comprises a lower edge portion of said first wall of said bathtub unit support structure; and, said lower edge portion of said first wall of said bathtub support structure matingly engages said channel member to provide a structural joint securely interconnecting said bathtub and said shower units.

10. The combination bathtub/shower facility as set forth in claim 1, wherein said securely interconnecting means comprises means for structurally joining said first wall of said bathtub unit with said first portion of said shower dam, thereby providing a structural joint therebetween.

11. The combination bathtub/shower facility as set forth in claim 10, further comprising waterproof means for sealing said structural joint.

12. A combination bathtub/shower facility as set forth in claim 1, wherein said securely interconnecting means is configures to interconnect said shower unit to said bathtub unit in a right-handed arrangement, and further comprising:

additional means for securely interconnecting said bathtub unit and said shower unit, wherein said additional securely interconnecting means is configures to interconnect said shower unit to said bathtub unit in a left-handed arrangement.

13. The combination bathtub/shower facility as set forth in claim 6, further comprising:

a prefabricated first shower wall extender panel mounted to the upper edge of said first shower wall to extend the height thereof: and, means for securing said first shower wall extender panel to said first shower wall.

14. The combination bathtub/shower facility as set forth in claim 6, wherein said shower pan and said shower dam cooperatively define a shower base portion, and wherein further, said facility further comprises:

at least one shower wall mounted to said shower base portion; and means for securing said shower wall(s) to said shower base portion.

* * * * *